US009707692B2

(12) United States Patent
Wang et al.

(10) Patent No.: US 9,707,692 B2
(45) Date of Patent: Jul. 18, 2017

(54) CUTTERHEAD COMPONENT FOR SHREDDING/SLICING FOODS AND FOOD PROCESSOR HAVING THE CUTTERHEAD COMPONENT

(71) Applicant: ELEC-TECH INTERNATIONAL CO., LTD., Zhuhai, Guangdong (CN)

(72) Inventors: Tony Wang, Zhuhai (CN); Xuejun Chen, Zhuhai (CN); Jianwei Chen, Zhuhai (CN)

(73) Assignee: ELEC-TECH INTERNATIONAL CO., LTD., Zhuhai (CN)

( * ) Notice: Subject to any disclaimer, the term of this patent is extended or adjusted under 35 U.S.C. 154(b) by 461 days.

(21) Appl. No.: 14/460,059

(22) Filed: Aug. 14, 2014

(65) Prior Publication Data

US 2015/0183122 A1 Jul. 2, 2015

(30) Foreign Application Priority Data

Dec. 31, 2013 (CN) ..... 2013 2 0891551 U

(51) Int. Cl.

| | |
|---|---|
| ***B26D 1/29*** | (2006.01) |
| ***B26D 7/26*** | (2006.01) |
| *B26D 3/28* | (2006.01) |

(52) U.S. Cl.

CPC ..... *B26D 7/2628* (2013.01); *B26D 1/29* (2013.01); *B26D 2003/285* (2013.01)

(58) Field of Classification Search

CPC ... B26D 7/2628; B26D 1/29; B26D 2003/285
USPC ..... 241/92
See application file for complete search history.

(56) References Cited

U.S. PATENT DOCUMENTS 8,602,335 B2 * 12/2013 Krasznai ..... A47J 43/0711 241/278.1
2011/0139017 A1 * 6/2011 Beber ..... A47J 43/085 99/537

* cited by examiner

*Primary Examiner* — Mark Rosenbaum
(74) *Attorney, Agent, or Firm* — Kagan Binder, PLLC

(57) ABSTRACT

Provided are a cutterhead component for shredding and/or slicing foods and a food processor having the cutterhead component herein. The cutterhead component includes: a cutterhead with a dropping gap, a cutter body and a turncap; the cutterhead is divided into a fixed cutterhead and a movable cutterhead by a dividing plane passing through the dropping gap and a rotation axis, the movable cutterhead is provided with a central axle along its rotation axis, and a driven part is disposed on an outer surface of the central axle; the turncap is rotatably sleeved on the central axle, a driving part is disposed on an inner wall of the turncap, the driving part engages with the driven part, forming a lead screw mechanism. With regard to the cutterhead component for shredding and/or slicing foods, the thickness of cut-out foods can be regulated according to requirements, thereby satisfying different demands of users.

17 Claims, 4 Drawing Sheets

CUTTERHEAD COMPONENT FOR SHREDDING/SLICING FOODS AND FOOD PROCESSOR HAVING THE CUTTERHEAD COMPONENT

CROSS-REFERENCE TO RELATED APPLICATIONS

This application claims priority to Chinese Application No. 201320891551.2, "Cutterhead Component for Shredding/Slicing Foods and Food Processor having the Cutterhead Component", filed on Dec. 31, 2013, which is hereby incorporated by reference in its entirety.

TECHNICAL FIELD

The present disclosure relates to kitchen utensils, and more particularly to a cutterhead component for shredding/slicing foods and a food processor having the cutterhead component.

BACKGROUND ART

A food processor having shredding/slicing functions usually includes: a driving engine, a main body, a lid, a cutterhead component and a transmission axle; wherein, the main body is disposed above the driving engine, the lid is disposed above the main body, and a feeding channel is provided on the lid; the transmission axle is disposed along the rotation axis of the main body. The cutterhead component is disposed on the upper end of the transmission axle, and the cutterhead component has a cutter body extending in the radial direction. When cutting food, the driving engine drives the cutterhead component to rotate through the transmission axle, the foods enter the cutterhead component in the main body through the feeding channel of the lid, and the cutter body of the cutterhead component cuts the foods into slices or shreds.

The cutterhead component in the prior art has following defects: due to the fixed level of the cutter body edge and the fixed level of the cutterhead component, only one thickness of the cut-out food can be obtained, which can not satisfy demands of users; otherwise, the user has to prepare multiple cutterhead components, of which the cost is too high.

SUMMARY OF THE INVENTION

In view of the defects existing in the prior art, in one aspect, the present disclosure provides a cutterhead component for shredding and/or slicing foods, which can adjust the thickness of the cut-out food, so as to satisfy the demands of users.

A cutterhead component for shredding and/or slicing foods, including:

a cutterhead, being able to rotate around a rotation axis, and a dropping gap extending in radial direction is disposed on the cutterhead;

a cutter body, disposed above the dropping gap; and a turncap;

wherein, the cutterhead is divided into a fixed cutterhead and a movable cutterhead by a dividing plane passing through the dropping gap and the rotation axis, and the movable cutterhead is capable of moving relative to the fixed cutterhead in direction of said rotation axis, the cutter body is fixed on an upper surface of the fixed cutterhead, the movable cutterhead is provided with a central axle along its rotation axis, and a driven part is disposed on an outer surface of said central axle;

and the turncap is rotatably sleeved on the central axle, a driving part is disposed on an inner wall of the turncap, and the driving part engages with the driven part, forming a lead screw mechanism.

In some embodiments, the driven part is an external thread disposed on the outer surface of the central axle, and the driving part is an internal thread matching with the external thread disposed on an inner wall of the turncap.

In some embodiments, the central axle is hollow structure, the fixed cutterhead is provided with a mounting axle along its rotation axis, and the mounting axle is disposed inside the central axle of the movable cutterhead.

In some embodiments, the mounting axle is hollow structure, and a mounting hole for matching with a driving axle is disposed on an upper end of the mounting axle.

In some embodiments, an axial limiting mechanism is disposed between the central axle of the movable cutterhead and the mounting axle of the fixed cutterhead.

In some embodiments, the axial limiting mechanism includes an annular groove disposed on an outer surface of a lower end of the mounting axle, and a flange disposed on an inner wall of a lower end of the turncap used for matching with the annular groove, and the flange is snapped into the annular groove.

In some embodiments, a first guide track or a first guide slot is disposed on an outer surface of the mounting axle, and a second guide slot or a second guide track for matching with the guide track or the guide slot is disposed on an inner wall of the central axle.

In some embodiments, an upper surface of the fixed cutterhead is an annular inclined surface, and a height of the upper surface of the fixed cutterhead is reduced gradually, starting from a position of the cutter body, along a direction opposite to a rotating direction of the cutterhead component.

In some embodiments, an upper surface of the movable cutterhead is an annular inclined structure, and a height of the upper surface of the movable cutterhead is taken a lowest position of the upper surface of the fixed cutterhead as a datum point, and is reduced gradually, starting from a lowest position of the upper surface of said fixed cutterhead, along a direction opposite to the rotating direction of said cutterhead component.

In another aspect, the present disclosure provides a food processor having the cutterhead component for shredding and/or slicing foods mentioned above.

A food processor, including a driving device and a main component, and the main component includes a main body, a lid, a transmission axle and a cutterhead component, wherein, the cutterhead component is the cutterhead component for shredding and/or slicing foods mentioned above.

As compared to the prior art, with regard to the cutterhead component for shredding and/or slicing foods provided in the present disclosure, since the cutterhead component is divided into the movable cutterhead and the fixed cutterhead, and the movable cutterhead can move up and down relative to the fixed cutterhead within a certain distance while the fixed cutterhead is motionless in the up and down direction, the height from the cutting edge of the cutting body to the movable cutterhead (namely the height of the dropping gap) can be changed, thereby changing the thickness of the cut-out food and satisfying different demands of users.

Wherein, the elements are denoted as follows:

000 - - - Cutterhead;

100 - - - Fixed cutterhead; 110 - - - Mounting axle; 111 - - - Annular groove;

112 - - - Guide slot; 120 - - - Annular outer edge; 130 - - - Annular flange;

140 - - - Upper surface of the fixed cutterhead; 150 - - - mounting hole;

200 - - - Movable cutterhead; 210 - - - Central axle; 212 - - - External thread;

211 - - - Guide track; 220 - - - Upper surface of the movable cutterhead;

300 - - - Cutter body; 310 - - - Height of the cutter body H;

400 - - - Turncap; 420 - - - Internal thread; 430 - - - Flange; 500 - - - Dropping gap.

PREFERRED EMBODIMENTS OF THE INVENTION

In order to make the purpose, technical solutions and advantages of the present disclosure to be understood more clearly, the present disclosure will be described in further details with the accompanying drawings and the following embodiments. It should be understood that the specific embodiments described herein are merely examples to illustrate the disclosure, not to limit the present disclosure.

Figure 1:
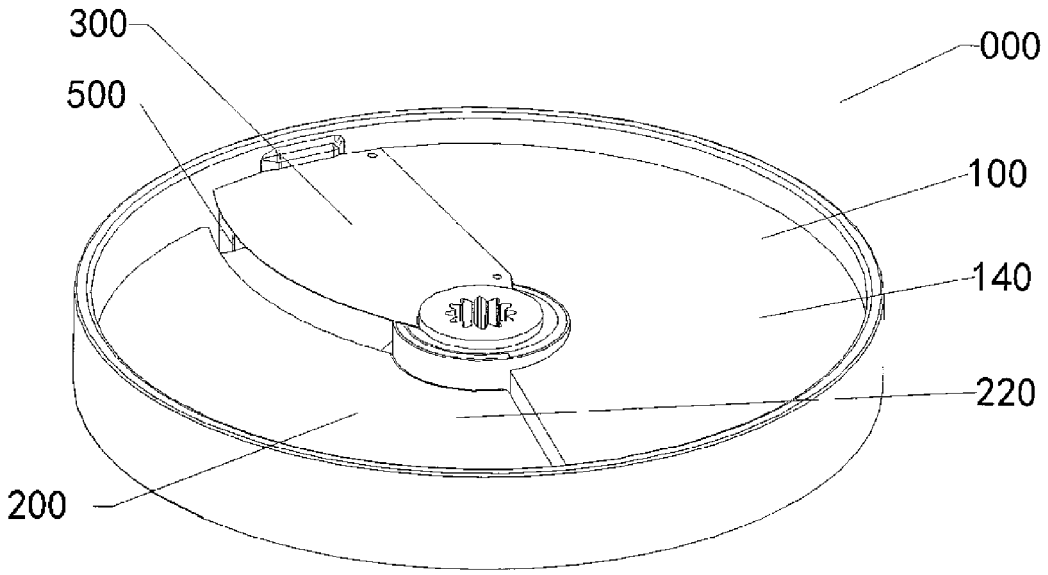
FIG. 1 is an assembly diagram illustrating the cutterhead component for shredding/slicing foods according to one embodiment of present invention.
Figure 2:
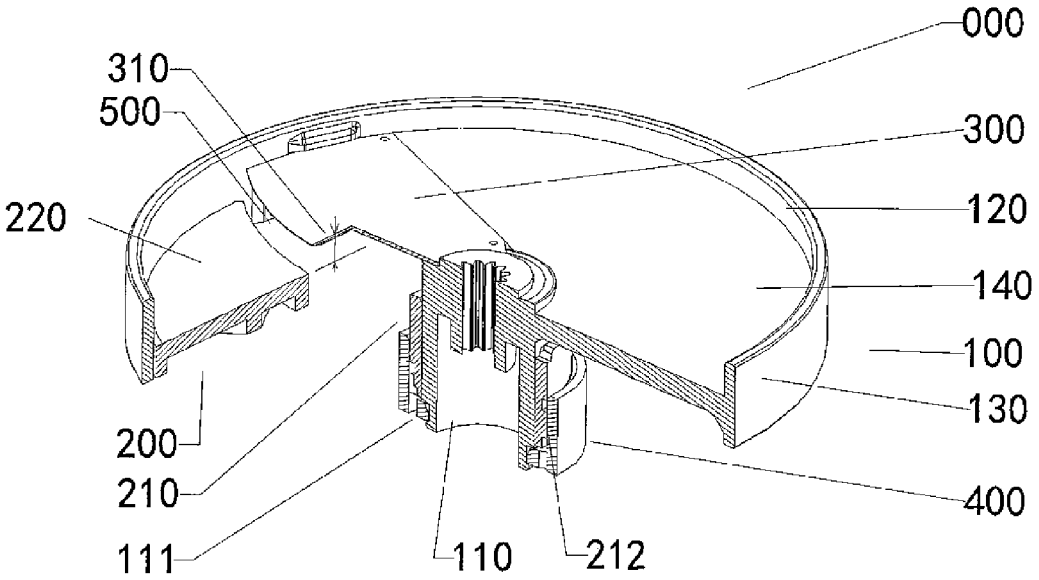
FIG. 2 is a section view illustrating the cutterhead component for shredding/slicing foods as shown in FIG. 1.
Figure 3:
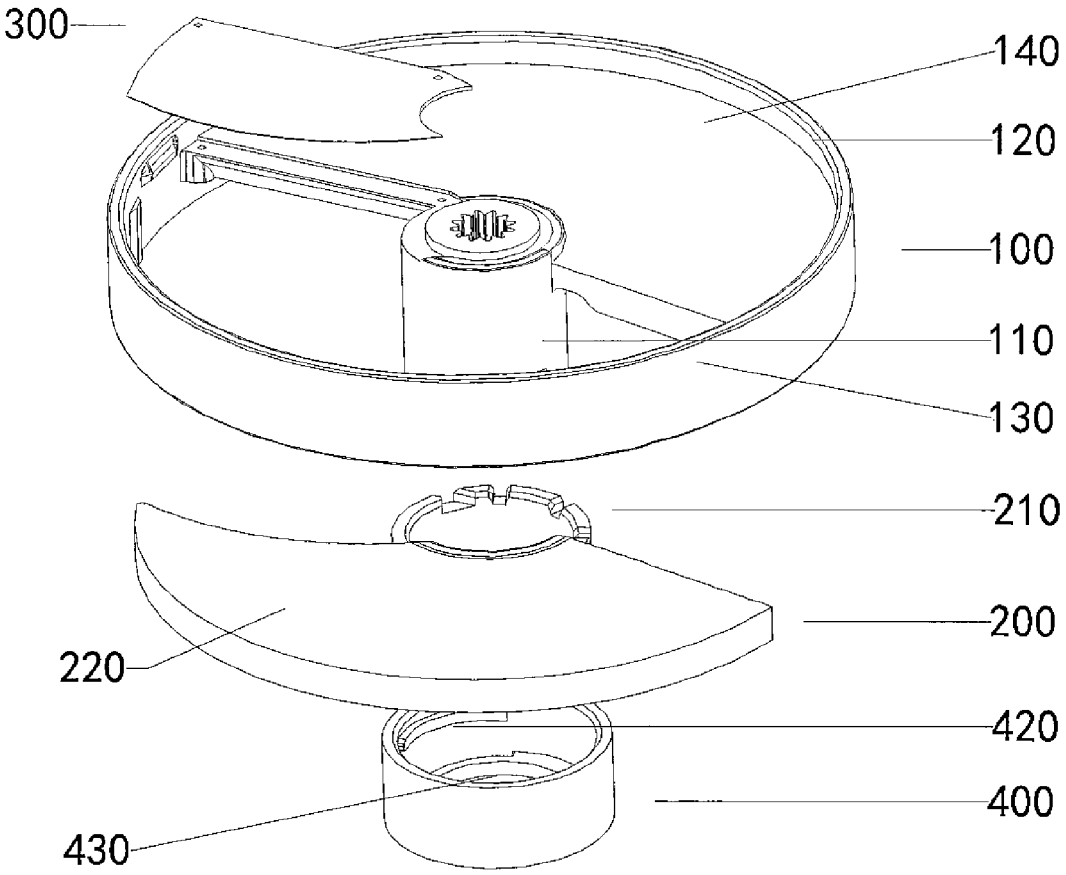
FIG. 3 is an exploded view illustrating the cutterhead component for shredding/slicing foods as shown in FIG. 1.
Figure 5:
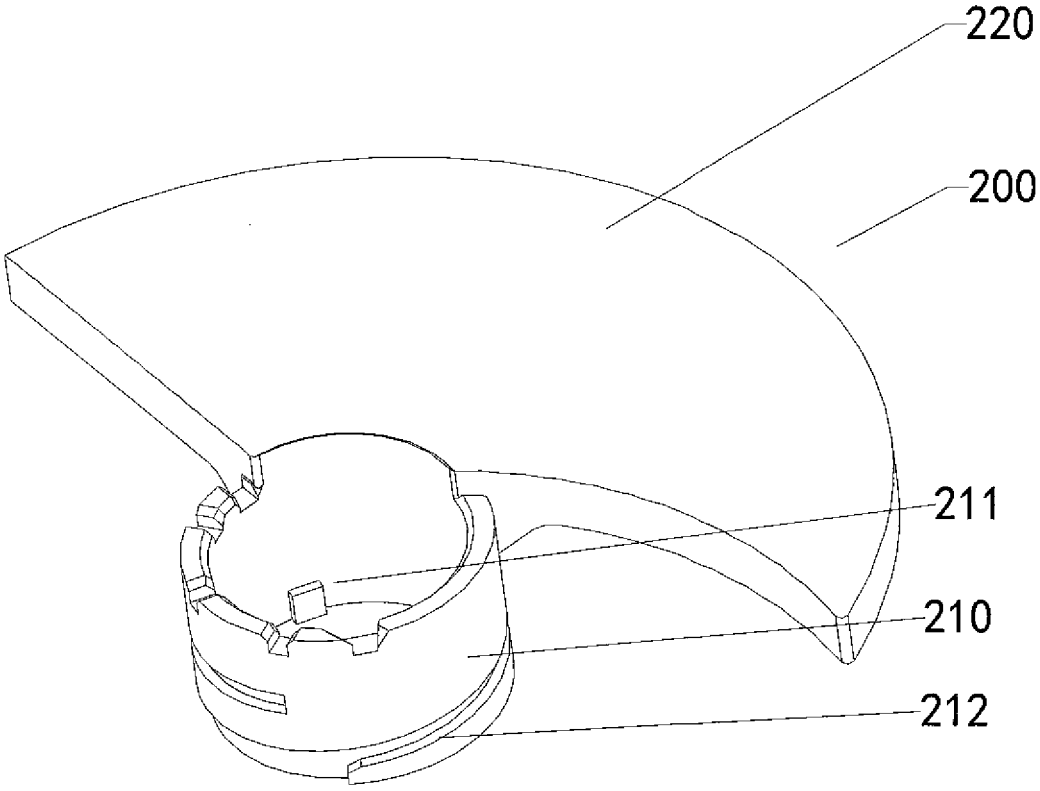
FIG. 5 is a three-dimensional structural diagram illustrating the movable cutterhead of the cutterhead component for shredding/slicing foods as shown in FIG. 1.
Figure 6:
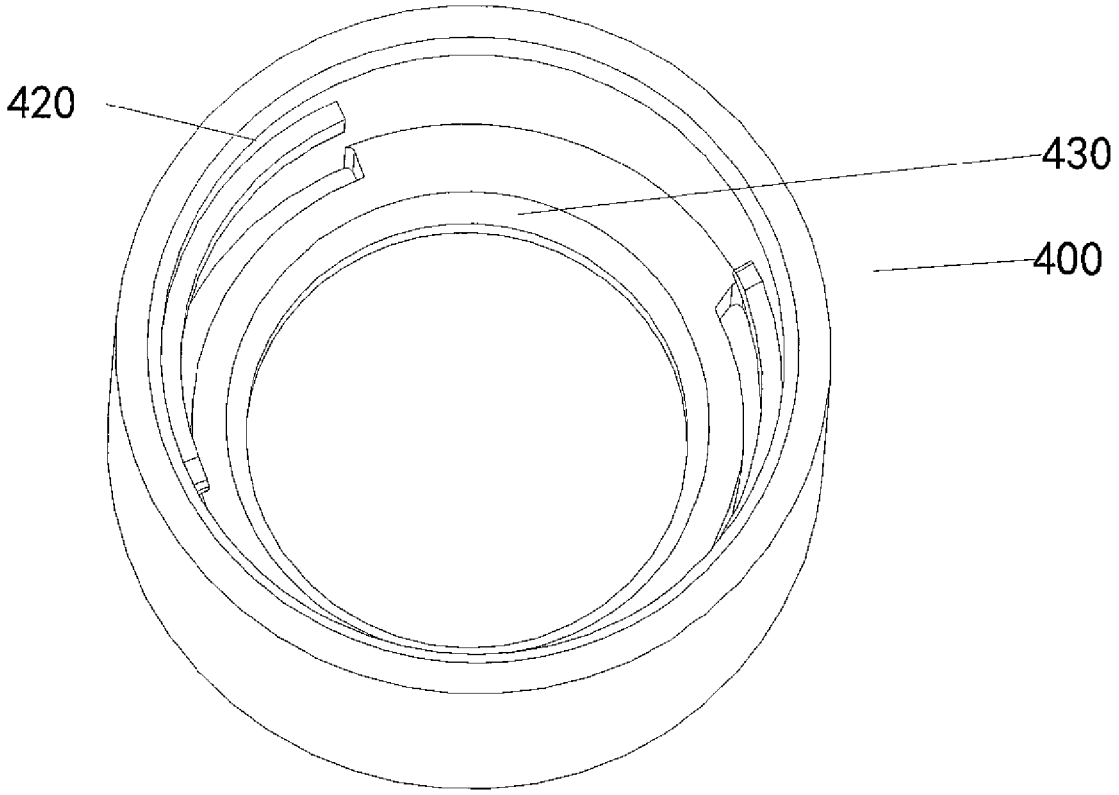
FIG. 6 is a three-dimensional structural diagram illustrating the turncap of the cutterhead component for shredding/slicing foods as shown in FIG. 1.

A cutterhead component for shredding and/or slicing foods is provided in one embodiment of the present disclosure. FIG. 1 is an assembly diagram illustrating the cutterhead component for shredding and/or slicing foods according to this embodiment; FIG. 2 is a section view illustrating the cutterhead component for shredding and/or slicing foods as shown in FIG. 1; and FIG. 3 is an exploded view illustrating the cutterhead component for shredding and/or slicing foods as shown in FIG. 1. As shown in FIG. 1 to FIG. 3, the cutterhead component includes a cutterhead 000, a cutter body 300 and a turncap 400; wherein, the cutterhead 000 is round in shape, and is able to rotate around a rotation axis, and a dropping gap 500 extending in radial direction is disposed on the cutterhead 000. The cutterhead 000 is divided into a fixed cutterhead 100 and a movable cutterhead 200 by a dividing plane passing through the dropping gap 500 and the rotation axis, and the movable cutterhead 200 can, in the direction of the rotation axis, move relative to the fixed cutterhead 100, the movable cutterhead 200 is provided with a central axle 210 along its rotation axis, and a driven part is disposed on the outer surface of the central axle 210, in some embodiments, the driven part is an external thread 212 disposed on the outer surface of the central axle 210 (as shown in FIG. 5). The turncap 400 is rotatably sleeved on the central axle 210, a driving part is disposed on an inner wall of the turncap 400, in some embodiments, the driving part is an internal thread 420 disposed on the inner wall of the turncap 400, which engages with the external thread 212 (as shown in FIG. 6). The external thread 212 engages with the internal thread 420, forming a lead screw mechanism, and by means of rotating the turncap 400, the central axle 210 can be driven to move along the rotation axis, and the movable cutterhead 200 is further driven to move along the rotation axis, as a result, the height H from the cutter body 300 to the movable cutterhead 200 is changed, thereby changing the thickness of cut-out foods and satisfying demands of users.

Figure 4:
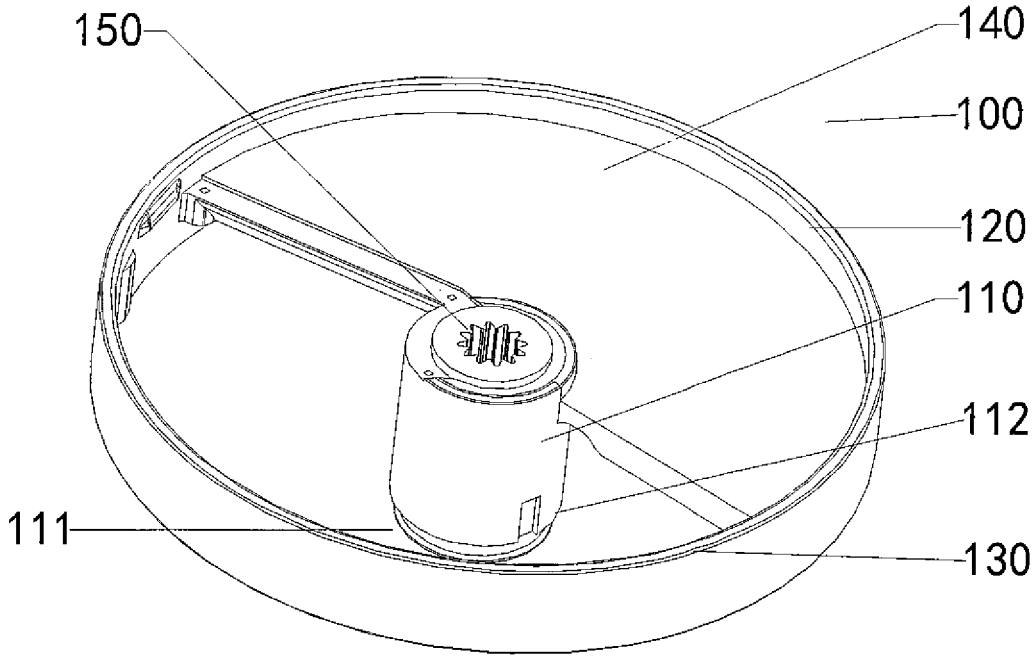
FIG. 4 is a three-dimensional structural diagram illustrating the fixed cutterhead of the cutterhead component for shredding/slicing foods as shown in FIG. 1.

In some embodiments, as shown in FIG. 4, the central axle 210 is a hollow structure, the fixed cutterhead 100 is provided with a mounting axle 110 along its rotation axis, and the mounting axle 110 is disposed inside the central axle 210. Furthermore, the mounting axle 110 is a hollow structure, and a mounting hole 150 for engaging with a driving axle is disposed on an upper end of the mounting axle 110. The driving axle drives the mounting axle 110 to rotate, and the mounting axle 110 drives the fixed cutterhead 100 to rotate simultaneously.

In order to enable a relative displacement between the movable cutterhead 200 and the fixed cutterhead 100, the rotation axis of the turncap 400 and the rotation axis of the fixed cutterhead 100 should remain unchanged in direction, the movable cutterhead 200 is driven to move along the central axis 210 by means of rotating the turncap 400, and an axial limiting mechanism is disposed between the central axle 210 and the mounting axle 110. The axial limiting mechanism in this embodiment includes an annular groove 111 disposed on an outer surface of the lower end of the mounting axle 110 (as shown in FIG. 2), and a flange 430 disposed on an inner wall of the lower end of the turncap 400 for matching with the annular groove 111 (as shown in FIG. 2 and FIG. 6), and the flange 430 is snapped into the annular groove 111, thereby the flange 430 can not axially move but rotate around the mounting axle 110 only.

In order to ensure the movable cutterhead 200 only can move up and down along the rotation axis of the fixed cutterhead 100 without generating any angular deflection, in some embodiments, as shown in FIG. 4, a guide slot 112 is disposed on the lower end of the mounting axle 110, and the guide slot 112 extends straight upwards in the axial direction of the mounting axle 110 from the lower end face of the mounting axle 110. A guide track 211 for engaging with the guide slot 112 is disposed on the lower end of the central axle 210 of the movable cutterhead 200, and the guide track 211 extends straight upwards in the axial direction of the central axle 210 from the lower end face of the central axle 210.

As shown in FIG. 4, in order to prevent the outer edge of the movable cutterhead 200 from radially tilting due to poor strength and matching errors between components, and to enhance the strength of the outer edge of the whole cutterhead component, in some embodiments, an annular flange 130 is axially disposed upwards and downwards on the annular outer edge 120 of the fixed cutterhead 100, and the annular flange 130 surrounds the movable cutterhead 200.

As shown in figures, when the movable cutterhead 200 moves to the lowest point along the rotation axis, there will be a larger height difference between the upper surface of the fixed cutterhead 100 and the upper surface of the movable cutterhead 200; as a result, when cutting food with the larger height difference mentioned above, since the height is not unified, the food will be cut by the cutter body 300 before the bottom of the food touches the upper surface of the movable cutterhead 200, thereby the actual thickness of the cut-out food cannot reach the required thickness. Therefore, in this embodiment, the upper surface 140 of the fixed cutterhead 100 is an annular inclined surface, and the height of the upper surface of the fixed cutterhead 100 is reduced gradually, starting from the position of the cutter body, along a direction opposite to the rotating direction of the cutterhead component (as shown in FIG. 1). In some embodiments, the upper surface 220 of the movable cutterhead 200 is an annular inclined surface, and the height of the upper surface 220 of the movable cutterhead 200 is reduced gradually, starting from the lowest position of the upper surface of the fixed cutterhead 100, along a direction opposite to the rotating direction of the cutterhead component (as shown in FIG. 1).

A food processor is provided in another embodiment of the present disclosure, including a driving device and a main component, and the main component includes a main body, a lid, a transmission axle and a cutterhead component, wherein, the cutterhead component is the cutterhead component for shredding and/or slicing foods mentioned above.

It should be understood by those skilled in the art that what described above are preferred embodiments of the present invention. Various modifications and replacements may be made therein without departing from the theory of the present disclosure, and should also be seen in the scope of the present disclosure.

What is claimed is:

1. A cutterhead component for shredding and/or slicing foods, comprising:

a cutterhead, being able to rotate around a rotation axis, and a dropping gap extending in radial direction is disposed on said cutterhead;

a cutter body disposed above said dropping gap; and a turncap;

wherein, said cutterhead is divided into a fixed cutterhead and a movable cutterhead by a dividing plane passing through said dropping gap and said rotation axis, and said movable cutterhead is capable of moving relative to said fixed cutterhead in direction of said rotation axis; said cutter body is fixed on an upper surface of said fixed cutterhead, said movable cutterhead is provided with a central axle along its rotation axis, and a driven part is disposed on an outer surface of said central axle, an upper surface of said fixed cutterhead is an annular inclined surface, and a height of the upper surface of said fixed cutterhead is reduced gradually, starting from a position of said cutter body, along a direction opposite to a rotating direction of said cutterhead component;

and said turncap is rotatably sleeved on said central axle, a driving part is disposed on an inner wall of said turncap, and said driving part engages with said driven part, forming a lead screw mechanism.

2. The cutterhead component for shredding and/or slicing foods according to claim 1, wherein, said driven part is an external thread disposed on the outer surface of said central axle, and said driving part is an internal thread disposed on an inner wall of said turncap.

3. A food processor, comprising a driving device and a main component, and said main component comprises a main body, a lid, a transmission axle and a cutterhead component, wherein, said cutterhead component is the cutterhead component for shredding and/or slicing foods according to claim 2.

4. The cutterhead component for shredding and/or slicing foods according to claim 2, wherein, said central axle is a hollow structure, said fixed cutterhead is provided with a mounting axle along its rotation axis, and said mounting axle is disposed inside said central axle of the movable cutterhead.

5. The cutterhead component for shredding and/or slicing foods according to claim 1, wherein, said central axle is a hollow structure, said fixed cutterhead is provided with a mounting axle along its rotation axis, and said mounting axle is disposed inside said central axle of the movable cutterhead.

6. A food processor, comprising a driving device and a main component, and said main component comprises a main body, a lid, a transmission axle and a cutterhead component, wherein, said cutterhead component is the cutterhead component for shredding and/or slicing foods according to claim 5.

7. The cutterhead component for shredding and/or slicing foods according to claim 5, wherein, said mounting axle is a hollow structure, and a mounting hole for matching with a driving axle is disposed on an upper end of said mounting axle.

8. A food processor, comprising a driving device and a main component, and said main component comprises a main body, a lid, a transmission axle and a cutterhead component, wherein, said cutterhead component is the cutterhead component for shredding and/or slicing foods according to claim 7.

9. The cutterhead component for shredding and/or slicing foods according to claim 5, wherein, an axial limiting mechanism is disposed between said central axle of the movable cutterhead and said mounting axle of the fixed cutterhead.

10. A food processor, comprising a driving device and a main component, and said main component comprises a main body, a lid, a transmission axle and a cutterhead component, wherein, said cutterhead component is the cutterhead component for shredding and/or slicing foods according to claim 9.

11. The cutterhead component for shredding and/or slicing foods according to claim 9, wherein, said axial limiting mechanism comprises an annular groove disposed on an outer surface of a lower end of said mounting axle, and a flange disposed on an inner wall of a lower end of said turncap, for matching with said annular groove, and said flange is snapped into said annular groove.

12. A food processor, comprising a driving device and a main component, and said main component comprises a main body, a lid, a transmission axle and a cutterhead component, wherein, said cutterhead component is the cutterhead component for shredding and/or slicing foods according to claim 11.

13. The cutterhead component for shredding and/or slicing foods according to claim 5, wherein, a first guide track or a first guide slot is disposed on an outer surface of said mounting axle, and a second guide slot or a second guide track for matching with said first guide track or said first guide slot is disposed on an inner wall of said central axle.

14. A food processor, comprising a driving device and a main component, and said main component comprises a main body, a lid, a transmission axle and a cutterhead component, wherein, said cutterhead component is the cutterhead component for shredding and/or slicing foods according to claim 13.

15. The cutterhead component for shredding and/or slicing foods according to claim 1, wherein, an upper surface of said movable cutterhead is an annular inclined structure, and a height of the upper surface of said movable cutterhead is reduced gradually, starting from a lowest position of the upper surface of said fixed cutterhead, along a direction opposite to the rotating direction of said cutterhead component.

16. A food processor, comprising a driving device and a main component, and said main component comprises a main body, a lid, a transmission axle and a cutterhead component, wherein, said cutterhead component is the cutterhead component for shredding and/or slicing foods according to claim 15.

17. A food processor, comprising a driving device and a main component, and said main component comprises a main body, a lid, a transmission axle and a cutterhead component, wherein, said cutterhead component is the cutterhead component for shredding and/or slicing foods according to claim 1.

* * * * *